US006168087B1

(12) United States Patent
Cooke

(10) Patent No.: US 6,168,087 B1
(45) Date of Patent: Jan. 2, 2001

(54) VALVE, FOR USE WITH A FUEL INJECTOR

(75) Inventor: Michael Peter Cooke, Gillingham (GB)

(73) Assignee: Lucas Industries Limited, London (GB)

( * ) Notice: Under 35 U.S.C. 154(b), the term of this patent shall be extended for 0 days.

(21) Appl. No.: 09/418,614

(22) Filed: Oct. 15, 1999

(30) Foreign Application Priority Data

Oct. 23, 1998 (GB) ..... 9823134

(51) Int. Cl.[7] ..... F02M 61/20

(52) U.S. Cl. ..... 239/1; 239/88; 239/96; 239/533.2; 239/533.9; 239/600

(58) Field of Search ..... 239/88, 89, 96, 239/533.2, 533.8, 533.9, 124, 127, 584, 585.1, 600, 1; 137/625.65, 625.69

(56) References Cited

U.S. PATENT DOCUMENTS

| | | | | |
|---|---|---|---|---|
| 3,802,626 | * | 4/1974 | Regneault et al. | 239/553.8 X |
| 5,441,029 | * | 8/1995 | Hlousek | 239/96 X |
| 5,476,245 | * | 12/1995 | Augustin | 239/533.8 X |
| 5,524,825 | * | 6/1996 | Ueda | 239/127 X |
| 5,538,187 | * | 7/1996 | Mueller et al. | 239/533.9 X |
| 5,651,501 | * | 7/1997 | Maley et al. | 239/124 X |
| 5,660,331 | * | 8/1997 | Cooke | 239/124 |
| 5,947,380 | * | 9/1999 | Coldren et al. | 239/124 X |
| 5,961,052 | * | 10/1999 | Coldren et al. | 239/124 X |
| 5,979,790 | * | 11/1999 | Gurich et al. | 239/88 |

FOREIGN PATENT DOCUMENTS

| | | |
|---|---|---|
| 42 36 882 C1 | 4/1994 | (DE) . |
| 43 32 119 A1 | 3/1995 | (DE) . |
| 44 34 892 A1 | 4/1996 | (DE) . |
| 0 615 064 A1 | 9/1994 | (EP) . |

* cited by examiner

*Primary Examiner*—Andres Kashnikow
*Assistant Examiner*—Steven J. Ganey
(74) *Attorney, Agent, or Firm*—Ohlandt, Greeley, Ruggiero & Perle, L.L.P.

(57) ABSTRACT

A valve comprises a valve member which is engageable with a first seating to control communication between first and second ports and a second seating to control communication between second and third ports. The second seating is provided upon a separate seating member.

17 Claims, 3 Drawing Sheets

VALVE, FOR USE WITH A FUEL INJECTOR

This invention relates to a valve, and in particular to a three way valve suitable for use in controlling the operation of a fuel injector. It will be appreciated, however, that the valve may be suitable for use in other applications.

It is known to use a two way control valve in a fuel injector of the type used in a common rail type fuel system to control the fuel pressure within a control chamber, thereby controlling the timing of fuel injection. For example, the control chamber may communicate with a source of fuel under pressure through a restricted flow passage, the control valve controlling communication between the control chamber and a low pressure fuel reservoir. In such an arrangement, during injection of fuel, fuel may be able to flow at a restricted rate to the control chamber and from the control chamber to the low pressure reservoir. Clearly, the presence of such a fuel flow path results in the fuel system being inefficient.

The provision of such a flow path may be avoided by replacing the two way control valve with a three way valve arranged such that the control chamber communicates either with the source of fuel under pressure or with the low pressure reservoir. Direct communication between the source of fuel under pressure and the low pressure fuel reservoir is thus prevented or restricted to the periods during which the valve is being switched.

According to the present invention there is provided a valve comprising a valve member slidable within a bore formed in a valve housing, the valve member including a region of enlarged diameter which is engageable with a seating defined by part of the bore to control communication between a first port and a chamber, a second port communicating with the chamber, the valve member further being engageable with a seating defined by a seating member located within the chamber and obscuring a third port to control communication between the second port and the third port.

The seating member may be movable laterally within the chamber, or may be secured in position within the chamber by means of an adhesive material.

The valve member is preferably arranged to extend through an opening formed in the seating member, and to define a restriction to fluid flow between the second port and the third port when the valve member is spaced from the seating defined by the seating member. The restriction to fuel flow may be defined between the valve member and the seating member, or may be defined by a small diameter drilling formed in the valve member.

The valve member may be moveable under the control of an electromagnetic actuator operable against the action of a return spring. Alternatively, the valve member may be moveable under the control of a piezoelectric actuator.

The control valve may be used in controlling the operation of a fuel injector of the type including a supply passage or line arranged, in use, to communicate with a source of fuel under pressure, and a control chamber defined, in part, by a surface associated with the valve needle of the injector, the surface being orientated such that the application of fuel under pressure to the control chamber applies a force to the needle urging the needle towards an associated seating, the control valve being arranged such that the first port thereof communicates with the supply passage, the second port thereof communicates with the control chamber, the third port of the control valve communicating with a low pressure fuel reservoir.

The invention will further be described, by way of example, with reference to the accompanying drawings, in which.

Figure 1:
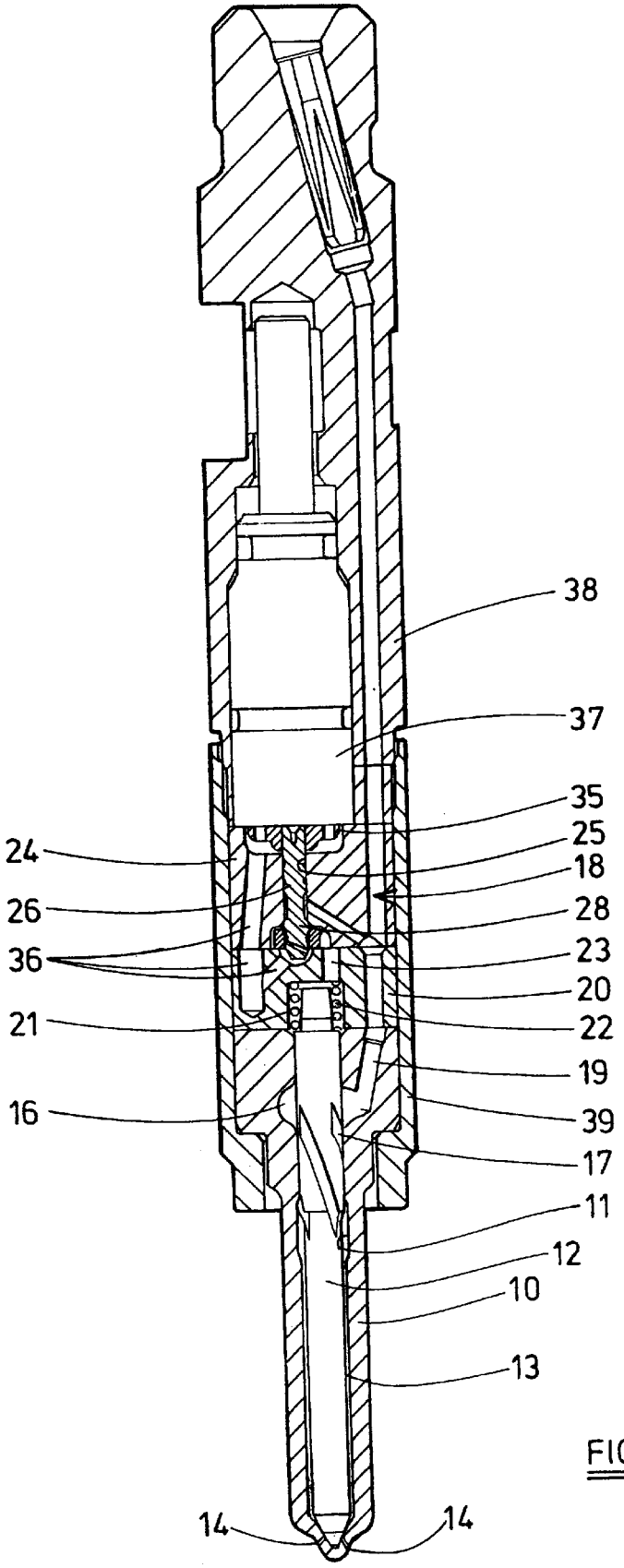
FIG. 1 is a sectional view illustrating a fuel injector incorporating a valve in accordance with an embodiment of the invention.
Figure 2:
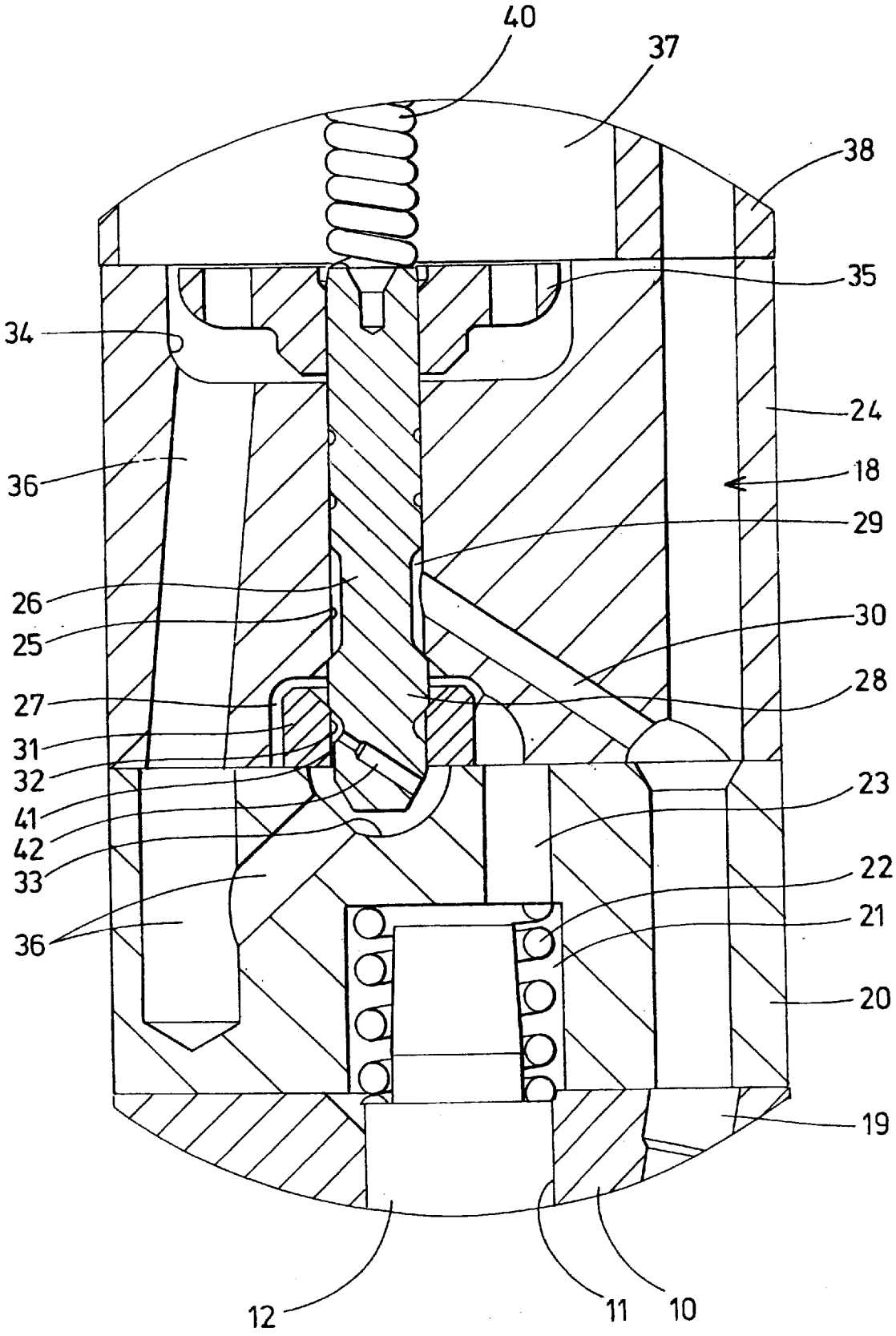
FIG. 2 is an enlargement of part of FIG. 1, illustrating the valve in greater detail.

The fuel injector illustrated in FIGS. 1 and 2 comprises a nozzle body 10 having a blind bore 11 formed therein. A valve needle 12 is reciprocable within the bore 11, the needle 12 including a relatively large diameter region shaped to cooperate with the adjacent part of the bore 11 to guide the needle 12 for sliding movement within the bore 11, and a reduced diameter portion which defines, with the bore 11, a delivery chamber 13. The needle 12 is arranged to be engageable with a seating to control the delivery of fuel from the delivery chamber 13 to a plurality of outlet openings 14 which open into the blind end of the bore 11 downstream of the seating.

The bore 11 defines an annular gallery 16 which communicates through flutes 17 formed in the needle 12 with the delivery chamber 13. The gallery 16 is arranged to be supplied with fuel under high pressure through a supply passage or line 18 defined, in part, by a drilling 19 provided in the nozzle body 10. The supply passage 18 conveniently communicates with the common rail of a common rail type fuel system which is charged to a suitably high pressure by an appropriate high pressure fuel pump.

The nozzle body 10 abuts a distance piece 20 which is provided with a blind bore defining a control chamber 21 into which an end of the needle 12 extends. A spring 22 is located within the control chamber 21, the spring 22 applying a biasing force to the needle 12 urging the needle 12 towards a position in which the needle 12 is in engagement with its seating. A drilling 23 is provided in the distance piece 20, the drilling 23 defining a fuel flow path between the control chamber 21 and the surface of the distance piece 20 remote from the nozzle body 10.

The distance piece 20 abuts a valve housing 24 which is provided with a through bore 25, eccentric to the axis thereof, within which a valve member 26 is slidable. The bore 25 is shaped, at its end adjacent the distance piece 20, to define a chamber 27, the chamber 27 being shaped and of suitable dimensions to communicate with the drilling 23. At the point at which the relatively small diameter, main part of the bore 25 opens into the chamber 27, the bore 25 is shaped to define a first conical valve seating with which an enlarged diameter region 28 of the valve member 26 is engageable. The part of the valve member 26 adjacent the enlarged diameter region 28 is of reduced diameter and defines, with the bore 25, an annular chamber 29 which communicates through a drilling 30 with the supply passage 18. It will be appreciated that the engagement between the enlarged diameter region 28 and the first valve seating controls communication between the supply passage 18 and the control chamber 21.

A seating member 31 is located within the chamber 27, the seating member 31 being of annular form. The seating member 31 defines a second valve seating with which the enlarged diameter region 28 of the valve member 26 is engageable. The seating member 31 defines an opening 32 through which the valve member 26 extends in a substantially piston like manner, the valve member 26 extending into a recess 33 formed in the adjacent face of the distance piece 20. The recess 33 communicates through drillings 36 formed in the distance piece 20 and the valve housing 24 with an armature chamber 34 formed in the end face of the valve housing 24 remote from the distance piece 20. The armature chamber 34 communicates through passages (not shown) with a low pressure fuel reservoir.

The seating member 31 is shaped so as to obscure the recess 33. As a result, when the enlarged diameter region 28 of the valve member 26 engages the second seating, communication between the control chamber 21 and the low pressure fuel reservoir is broken. Upon movement of the valve member 26 to move the enlarged diameter region 28 thereof away from the second valve seating, communication between the control chamber 21 and the low pressure fuel reservoir occurs. However, the rate at which fuel is able to flow towards the low pressure fuel reservoir is restricted to a relatively low level by the fit of the valve member 26 within the opening 32 of the seating member 31.

In order to permit fuel to flow towards the low pressure fuel reservoir, one or more grooves or flats 41 may be provided in the part of the valve member 26 which extends through the opening 32 of the seating member 31. Alternatively, or additionally, a small diameter drilling 42 may be provided in the valve member 26, the drilling 42 being positioned to permit fuel to flow at a restricted rate upon the enlarged diameter region 28 being lifted from the second seating.

The armature chamber 34 houses an armature 35 which is secured to the valve member 26. The armature 35 is moveable by an electromagnetic actuator 37 to cause movement of the valve member 26 between a rest position in which the valve member 26 cooperates with the second valve seating, and an energised position in which the valve member 26 cooperates with the first valve seating, against the action of a return spring 40. The actuator 37 is located within an actuator housing 38 to which the valve housing 24, the distance piece 20 and the nozzle body 10 are secured by a cap nut 39.

In use, with the actuator 37 de-energized, and with the supply passage 18 connected to a suitable source of fuel under high pressure, it will be appreciated that the delivery chamber 13 and the control chamber 21 are both charged with fuel to a high pressure. The effective area of the needle 12 exposed to the fuel pressure within the delivery chamber 13 is smaller than that within the control chamber 21 and as a result, the application of fuel under high pressure assists the spring 22 in urging the needle 12 into engagement with its seating. Injection of fuel does not, therefore, take place.

In order to commence injection, the actuator 37 is energised to move the armature 35, and hence the valve member 26, lifting the enlarged diameter region 28 of the valve member 26 away from the second seating and into engagement with the first seating. As a result, fuel is able to flow from the control chamber past the second seating to the low pressure fuel reservoir, the rate of fuel flow being restricted as described hereinbefore, and the flow of fuel to the control chamber 21 from the supply passage 18 is broken. The fuel pressure within the control chamber 21 falls, and a point will be reached beyond which the action of the fuel under pressure within the delivery chamber 13 will be sufficient to lift the needle 12 away from its seating against the action of the reduced fuel pressure within the control chamber 21 and the action of the spring 22. The movement of the needle 12 away from its seating permits fuel to flow past the seating to the outlet openings 14, thus delivery of fuel commences.

As the rate at which fuel is able to pass the second valve seating is restricted, it will be appreciated that the movement of the needle 12 away from its seating will occur at a relatively low rate.

When injection of fuel is to be terminated, the actuator 37 is de-energized, the valve member 26 returning to its original position under the action of the spring 40. As a result, the enlarged region 28 moves into engagement with the second valve seating, terminating the flow of fuel to the low pressure fuel reservoir, the region 28 moving away from the first valve seating thus permitting fuel to flow to the control chamber 21 from the supply passage 18. The fuel pressure within the control chamber 21 rises rapidly, and a point will be reached beyond which the control chamber pressure is sufficient to cause the needle 12 to return into engagement with its seating.

As the second valve seating is provided on a separate seating member 31 located and movable laterally within the chamber 27, it will be appreciated that manufacture of the injector is relatively simple, the difficulties associated with machining seatings in separate housing components which must align with one another, in use, being avoided. Instead, the seating member 31 is simply located within the chamber 27 during assembly, cooperation between the valve member 26 and the seating member 31 moving the seating member 31 to the correct position. In use, the fuel pressure within the chamber 27 and the low pressure within the recess 33 ensure that the seating member 31 remains in engagement with the distance piece 20.

Alternatively, the seating member 31 may be secured in position within the chamber 27 by means of an adhesive or semi-adhesive material. In this case, prior to assembly of the valve, an adhesive material is applied to a part of the upper end surface of the distance piece 20. When the valve is assembled, the seating member 31 is located within the chamber 27 and is secured in position within the chamber 27 by means of the adhesive material. Preferably, the material which is used will have adhesive properties which permit a small degree of lateral movement of the member 31 within the chamber 27 on assembly before the adhesive hardens, thereby enabling the seating member 31 to adopt a secured position within the chamber 27 in which the second valve seating is substantially concentric with the first valve seating defined by the bore 25.

The armature 35 must be secured to the valve member 26 after location of the valve member 26 within the bore 25. The armature 35 is conveniently a press fit, but may be secured to the valve member 26 by adhesive, or by welding, or the valve member may be arranged to form a screw thread in the armature.

The seating lines formed between the enlarged region 28 and the first and second valve seatings, and the opening formed in the seating member 31 are conveniently of diameter substantially equal to the diameter of the main part of the bore 25. As a result, the valve member 26 is substantially pressure balanced at all times. As a result, the actuator need only generate a relatively low magnitude force to control operation of the injector, and movement of the valve member 26 can occur rapidly.

Figure 3:
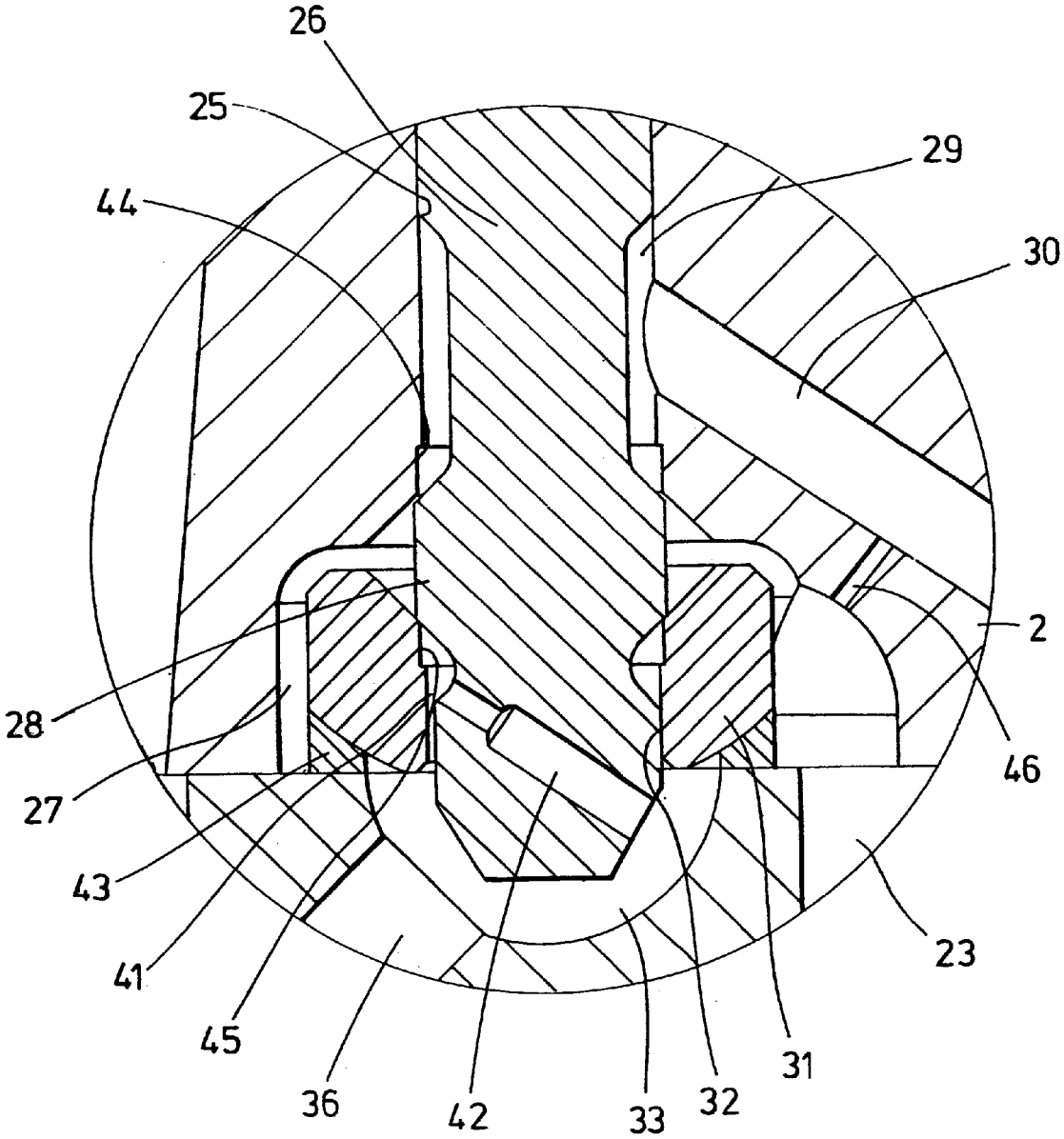
FIG. 3 is a view illustrating some modifications to the arrangement of FIGS. 1 and 2.

The arrangement shown in FIG. 3 is similar to that of FIGS. 1 and 2, and only the differences therebetween will be described in detail.

The first difference between the arrangement of FIG. 3 and that described hereinbefore is that the seating member 31 is shaped so that the face thereof which cooperates with the surface of the distance piece 20 is of part spherical form and is received within a part spherical recess formed in a seal member 43. The seal member 43 is free to move laterally within the chamber 27. The use of such a seal member is advantageous in that, if the bore 25 or the second valve seating are not exactly perpendicular to the end face of the distance piece 20, articulation of the seating member 31 relative to the seal member 43 can compensate for such inaccuracies.

A further distinction is that the diameter of the opening 32 is greater than that of the first valve seating. As a result, movement of the valve member 25 in the downward direction, in the orientation illustrated, occurs more rapidly than upward movement. The arrangement may further be modified so that the seating lines of the first and second valve seatings are of different diameters by incorporating appropriate diameter steps 44, 45 in the bore 25 and the opening 32. As a result, the timing of commencement of movement of the valve member 26 for a given fuel pressure, in either the upward or downward direction can be modified.

Finally, a small diameter drilling 46 provides a continuous restricted fuel flow path between the supply passage 18 and the chamber 27. The control chamber pressure can thereby be allowed to rise, during injection, to a level just below that necessary to cause movement of the needle towards its seating. As a result, when termination of injection is to occur, this can be achieved quickly.

Although in the embodiment and modifications described hereinbefore the valve member is moveable by an electromagnetic actuator, it will be appreciated that the valve is suitable for use with other types of actuator, for example a piezoelectric actuator.

I claim:

1. A valve comprising a valve member slidable within a bore formed in a valve housing, said valve member including a first means for engaging with a first seating defined by part of said bore to control communication between a first port and a chamber, a second port communicating with said chamber, said valve member including a second means for engaging with a second seating defined by a separate seating member located within said chamber to control communication between said second port and a third port, wherein said seating member is movable laterally within said chamber.

2. The valve as claimed in claim 1, wherein said valve member is arranged to extend through an opening formed in said seating member, and to define a restriction to fluid flow between said second port and said third port when said valve member is spaced from said second seating defined by said seating member.

3. The valve as claimed in claim 2, wherein said restriction to fluid flow is defined between said valve member and said seating member.

4. The valve as claimed in claim 2, wherein said restriction to fluid flow is defined by a small diameter drilling formed in said valve member.

5. The valve as claimed in claim 1, wherein said valve member is moveable under the control of an electromagnetic actuator against the action of a spring.

6. The valve as claimed in claim 1, wherein said valve member is moveable under the control of a piezoelectric actuator.

7. The valve as claimed in claim 1, wherein said first means for engaging comprises a first region of enlarged diameter of said valve member having a diameter larger than said first seating and said second means for engaging comprises a second region of enlarged diameter of said valve member having a diameter larger than said second seating.

8. The valve as claimed in claim 7, wherein said first region of enlarged diameter and said second region of enlarged diameter are the same region of enlarged diameter.

9. A fuel injector comprising supply passage or fine arranged, in use, to communicate with a source of fuel under pressure, and a control chamber defined, in part, by a surface associated with a valve needle of said injector, said surface being orientated such that the application of fuel under pressure to said control chamber applies a force to said valve needle urging said valve needle towards an associated seating, and a valve comprising a valve member slidable within a bore formed in a valve housing, said valve member including a first means for engaging with a first seating defined by part of said bore to control communication between a first port and a chamber, a second port communicating with said chamber, said valve member including a second means for engaging with a second seating defined by a separate seating member located within said chamber to control communication between said second port and a third port, wherein said seating member is movable laterally within said chamber and wherein the valve is arranged such that said first port thereof communicates with said supply passage, said second port thereof communicates with said control chamber, said third port of said valve communicating with a low pressure fuel reservoir.

10. A valve comprising a valve member slidable within a bore formed in a valve housing, said valve member including a first means for engaging with a first seating defined by part of said bore to control communication between a first port and a chamber, a second port communicating with said chamber, said valve member including a second means for engaging with a second seating defined by a separate seating member located within said chamber to control communication between said second port and third port, wherein said seating member is secured in place within said chamber by means of an adhesive, the adhesive having adhesive properties which permit lateral movement within the chamber, upon assembly, prior to hardening of the adhesive.

11. The valve as claimed in claim 10, wherein said valve member is arranged to extend through an opening formed in said seating member, and to define a restriction to fluid flow between said second port and said third port when said value member is spaced from said second seating defined by said seating member.

12. The valve as claimed in claim 11, wherein said restriction to fluid flow is defined between said valve member and said seating member.

13. The valve as claimed in claim 11, wherein said restriction to fluid flow is defined by a small diameter drilling formed in said valve member.

14. The valve as claimed in claim 10, wherein said valve member is moveable under the control of an electromagnetic actuator against the action of a spring.

15. The valve as claimed in claim 10, wherein said valve member is moveable under the control of a piezoelectric actuator.

16. A method of assembling a valve comprising the steps of:

providing a valve member including a first means for engaging with a first seating to control communication between a first port and a chamber, the chamber a communicating with a second port, arranging a separate seating member within the chamber so as to define a second seating, providing said valve member with a second means for engaging with said seating member to control communication between said second port and a third port, the separate seating member moveable laterally within the chamber upon initial arrangement within the chamber, and securing the separate seating member in position within the chamber once the seating member has been moved laterally to a desired position.

17. The method as claimed in claim 16, comprising the steps of:

applying an adhesive to a surface of the chamber, arranging the separate seating member within the chamber, and prior to hardening of the adhesive, moving the seating member laterally within the chamber until the seating member adopts a desired position.

* * * * *